United States Patent [19]

Dowdle

[11] Patent Number: 4,799,872

[45] Date of Patent: Jan. 24, 1989

[54] SLIPFORM APPARATUS FOR EMPLACING HORIZONTAL ARCUATE RE-INFORCING RODS

[76] Inventor: Paul A. Dowdle, "Twickenham", Manilla New South Wales 2346, Australia

[21] Appl. No.: 118,730

[22] Filed: Nov. 9, 1987

[30] Foreign Application Priority Data

Nov. 10, 1986 [AU] Australia ..... PH8880

[51] Int. Cl.[4] ..... E04G 11/22; E04G 21/16; B28B 21/56

[52] U.S. Cl. ..... 425/63; 249/20; 264/32; 264/35; 425/59; 425/122; 425/213

[58] Field of Search ..... 425/59, 63, 64, 65, 425/111, 122, 125, 126 R, DIG. 122, DIG. 130, 213; 264/32, 35, 310, 311; 249/17, 20, 48, 51

[56] References Cited

U.S. PATENT DOCUMENTS 887,255 5/1908 Kjellström ..... 425/122
1,134,202 4/1915 Jensen ..... 425/122
2,579,183 12/1951 Freyssinet ..... 425/111

FOREIGN PATENT DOCUMENTS 1046104 10/1983 U.S.S.R. ..... 425/122

*Primary Examiner*—Jay H. Woo
*Assistant Examiner*—James C. Housel
*Attorney, Agent, or Firm*—Freilich, Hornbaker Rosen & Fernandez

[57] ABSTRACT

A slip-form of the kind for defining at least one surface of a wall-space into which concrete is to be poured. The slip-form includes a plurality of spaced apart upwardly extending members and to facilitate the locating of reinforcing rods at selected positions in the wall-space the slip-form includes roller assemblies releasably engaged with at least some of the support members to form within the wall space a height adjustable horizontal race and an inclined race feeding down to said horizontal race. The inclined race being adapted to transport reinforcing rods onto the horizontal race for onward transport to a location adjacent the selected position in the reinforcing structure.

7 Claims, 5 Drawing Sheets

SLIPFORM APPARATUS FOR EMPLACING HORIZONTAL ARCUATE RE-INFORCING RODS

BACKGROUND OF THE INVENTION

1. Field of the Invention

This invention relates to the construction of reinforced concrete walls, in particular curved walls such as those of above-ground silos or in-ground tanks or the like.

2. Description of the Prior Art

Such walls are conventionally constructed with the aid of a slip-form which defines at least the inner surface of a wall-space into which the concrete is poured, and which is raised progressively as the poured concrete hardens. The slip-form also supports a working platform for the operators, who position reinforcing and pour the concrete.

As a general rule the reinforcing in such walls is a structure comprising an array of vertical rods and an array of horizontal rings of rods spaced one above the other and secured to the vertical rods. Often there are two such structures, one disposed adjacent the inner surface of the wall and the other disposed near the outer surface of the wall.

The slip-form as a whole is normally supported by a plurality of yokes extending upwards and into the wall space to engage jacks usually secured to or operating on previously emplaced vertical rods. The slip-form may be raised by those jacks as the wall is built.

Thus, whereas the vertical rods may be readily enough lowered into position by a crane the horizontal rods are more difficult to position since the yokes encroach into the wall-space and prevent them from being lowered into place while they are horizontal.

Of course, the slip-form could be raised by means which do not attach to yokes. In which case any other upwardly extending support or guide members, such as those required to support the formwork or prevent lateral movement of the slip-form as it is raised may be utilized in the invention to provide a mechanism which assists in positioning the horizontal reinforcement rods.

Hitherto the horizontal rods have been man-handled into position by a gang of men standing on the working platform.

SUMMARY OF THE INVENTION

According to the invention there is provided a slip-form for defining at least one surface of a wall-space into which reinforcing rods are located at selected positions to form a reinforcing structure and concrete poured, the slip-form including a plurality of spaced apart upwardly extending members, and roller assemblies releasably engaged with at least some of the members to form within said space a height adjustable horizontal race and an inclined race feeding down to said horizontal race, said inclined race being adapted to transport reinforcing rods onto the horizontal race for onward transport to a location adjacent to the selected position in the reinforcing structure.

Preferably the roller assemblies comprise rollers mounted in brackets which are releasably engageable with racks secured to the upwardly extending members.

Advantageously a vertical pin is mounted at the distal end of each bracket in order to prevent the reinforcing rods from coming off the race.

Also preferably the roller assemblies releasably engage with the upwardly extending members associated with the slip-form defining the inner surface of a curved wall.

Furthermore a skid channel may advantageously be provided along the horizontal race in the region of the intersection with the inclined race. Also at least one motorised roller may be provided at the upper end of the inclined race to assist with feeding the reinforcing rods.

The invention will now be described by way of example only with reference to the following drawings.

DESCRIPTION OF THE PREFERRED EMBODIMENTS

Figure 1:
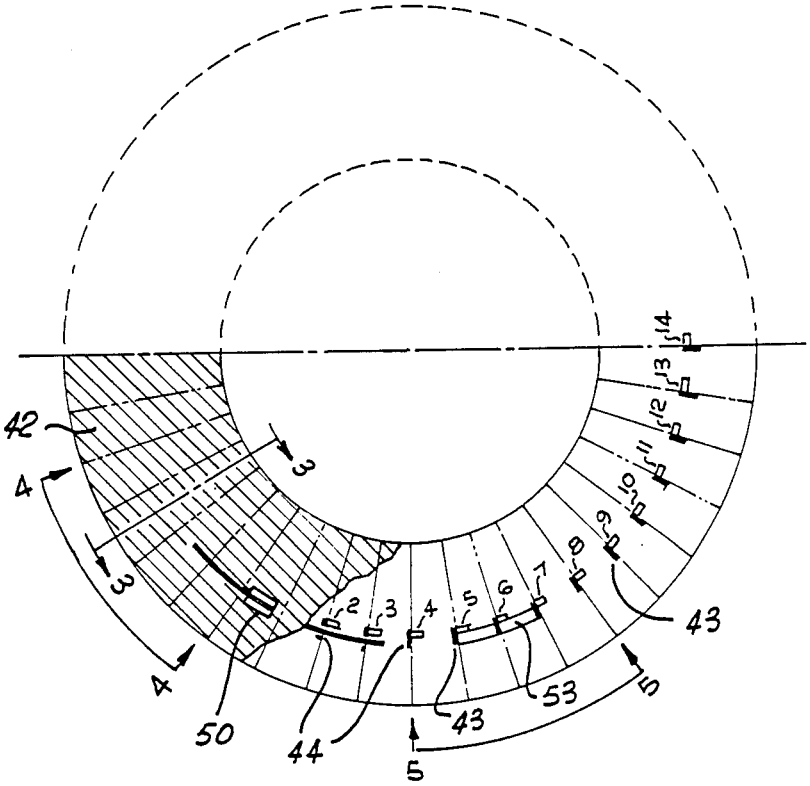
FIG. 1 is a schematic part sectional plan view of a reinforced concrete wall construction site.
Figure 2:
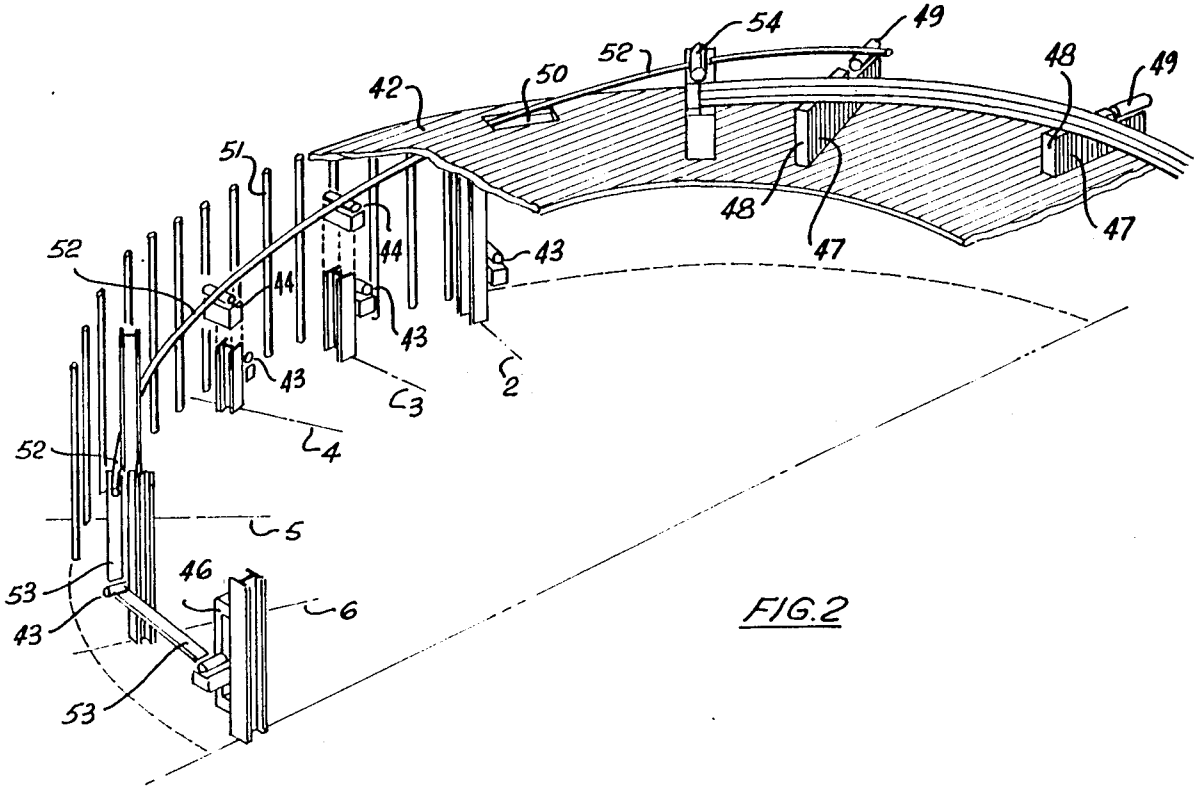
FIG. 2 is a schematic perspect view of part of the site shown in FIG. 1.
Figure 3:
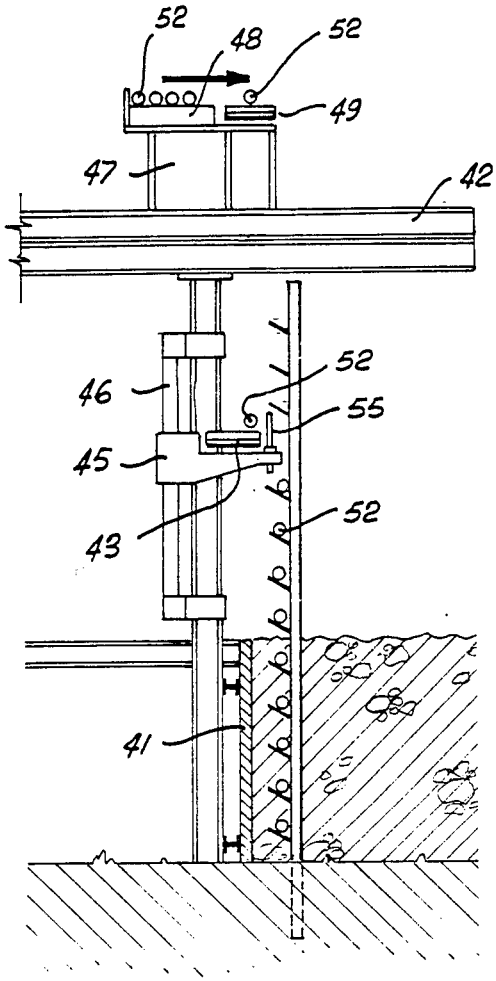
FIG. 3 is a sectional view between the arrows 3—3 of FIG. 1.
Figure 4:
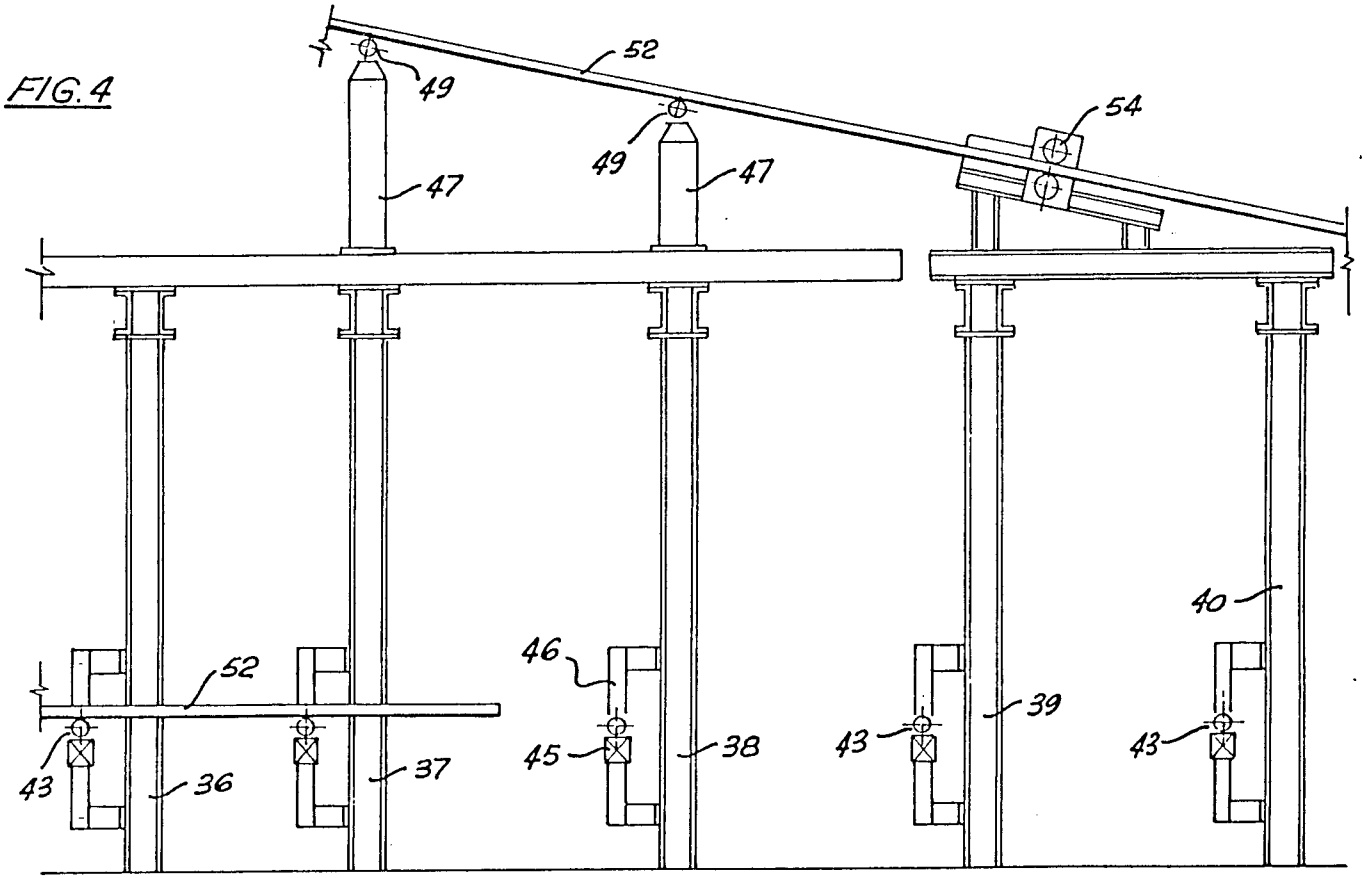
FIG. 4 is an elevation between the arrows 4—4 of FIG. 1.

Referring to FIGS. 1 to 5 a slip-form of substantially conventional construction includes vertical support members 1 to 40 (only some of which are shown) which locate formwork 41 (shown in FIG. 3 only) that defines the inner surface of a cylinderical wall to be constructed. The members 1–40 are disposed spaced about the edge of the area to be bounded by the wall. The outer surface of the wall to be constructed can also be formed by slip-form formwork or can be formed by an earthen wall formed by excavation for an inground structure. Prior to the pouring of concrete reinforcing rods are located at selected positions in the defined wall space to form a reinforcing structure as will be described in greater detail below.

A working deck (not shown) can be associated with the slip form in the conventional manner and raised or lowered up and down support members 1–40 in order to provide a convenient working platform. A further upper deck 42 also forms part of the slip form.

According to this invention a plurality of rollers assemblies 43, 44 are releaseably engaged with support members to form two faces. A first race formed by rollers 43 is a generally horizontal race extending around the annular wall-space. A second race includes rollers 44 is an inclined feed race which feeds onto the horizontal race. The rollers are mounted in brackets 45 which are releasably connected to the vertical support columns. Preferably this is achieved by means of the roller brackets 45 being mounted in a removable manner to any selected one of a range of attachment points on racks 46 which extend vertically up the slip-form support column. The rollers extending away from the support columns and into the wall-space.

The racks 46 are provided in at least two different lengths, short racks which are used to support rollers comprising only the work-race, and longer racks which are used on columns where it is desired to mount rollers for the work race and feed-race. The shorter racks 46 are long enough to enable the rollers to be moved up and down sufficiently to cover the range of heights at which horizontal reinforcement rods are to be installed. The longer racks 46 are long enough to reach from the lowest work race to the overhead deck.

The racks preferably have pins (not shown) projecting out of either side and a hole (not shown) in the surface which faces attached roller brackets 45. The roller brackets 45 have two hooks for engagement with the pins and a lug (not shown) which locates in the hole in the facing surface of the rack. The racks may be provided with holes all along the facing surface and pins all along either side, or the pins may be removable and only inserted when a bracket is to be attached. Preferably the racks are attached more or less in line with the support columns and the brackets extend laterally out of the line of the columns.

Blocks 47 which have a flat storage portion 48 adjacent a roller 49 are located on the upper deck 42. Blocks 47 are positioned such that rollers 49 form a curved path leading through an opening 50 in the deck to inclined feed race formed by rollers 44.

The reinforcing structure within the wall-space is formed as follows. Vertical reinforcing rods, indicated generally by 51, are positioned in the wall-space defined by the slip-form in the known manner. This is often done prior to location of the slip form. Pre-curved sections of horizontal reinforcing rods 52 are brought to the site and stacked, for instance by a crane, on flat portion 48 of blocks 47 on the upper deck 42. When required to form part of the inner reinforcing structure these reinforcing rods are pushed onto rollers 49 mounted on the blocks and then transported in a curved path around the deck and directed through opening 50 to the rollers 44 forming the inclined or feed race. The sections 52 pass down feed race and onto the horizontal race formed by rollers 43 for onward transport to a selected position adjacent the vertical reinforcing rods. The horizontal rod sections 52 are then pushed off the rollers and offered up and connected to the vertical rods by, for instance, welding.

Once a complete circumference of horizontal reinforcing rods are in place the horizontal or working race is raised by moving brackets 45 as described above to the height of the next desired reinforcing ring.

Figure 5:
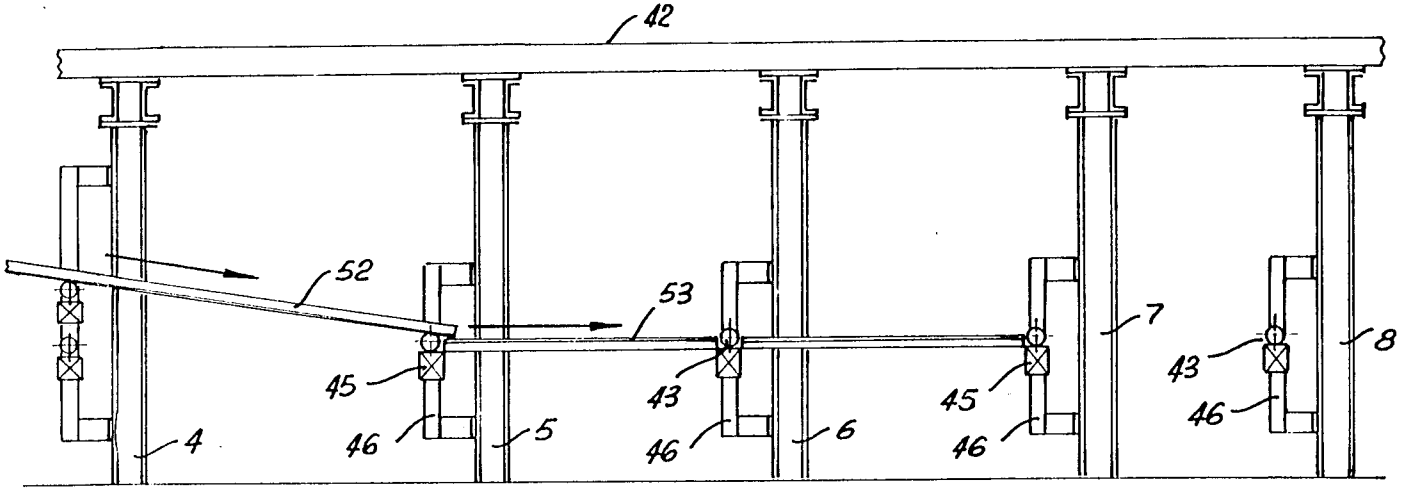
FIG. 5 is an elevation between the arrows 5—5 of FIG. 1.
Figure 5B:
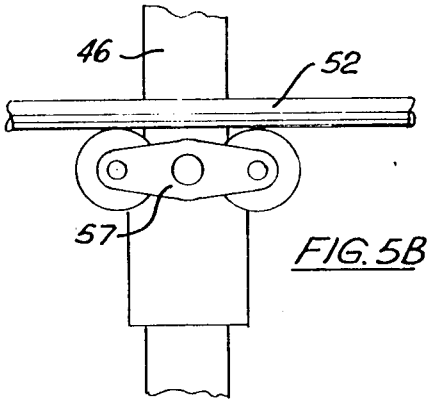
FIGS. 5*a* and 5*b* show a modification of the arrangement of FIG. 5.
Figure 5A:
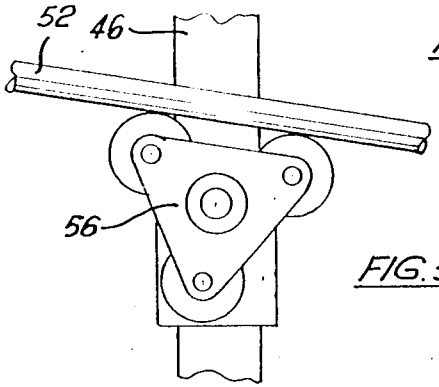

It is advantageous to provide a skid channel 53 at least in the region where the two races intersect. This may comprise some straight flat girders or bars. The skid channel 53 catches the ends of the reinforcement rods as they have to change direction at the bottom of the feed-race. In applications where heavier horizontal reinforcing rods are to be placed different roller arrangements are used in place of the skid channel. A tripple roller 55 arrangement as shown in FIG. 5*a* is used on support member 5 in place of roller 43 and dual roller arrangements 56 as shown in FIG. 5*b* are used on support members 6 and 7.

A pair of motorised rollers 54 arranged like a mangle may be used to grip and propel the reinforcement rods 52. This motorised feeder is preferably located in the region of the opening 50 in the upper deck 42 so that workmen may feed the reinforcement rods through the motorised rollers and onto the feed race. The purpose of the motorised feeder is to control the rate of decent of reinforcement rods down the inclined race. It is preferred that the motorised feeder has the capacity to also stop or reverse the rods if feeding difficulties are encountered.

Another preferred feature is to provide vertical pins 55 on the distal ends of the roller brackets 45 in order to ensure that the reinforcing rods 52 will stay on the rollers as they move along. The pins are designed to be removable or at least pivoted so that they may be moved out of the way and allow the rods to be slid sideways off the rollers when they arrive at their destinations.

Depending on the size of the wall to be built more than one feed-race and more than one work-race may be installed and operated simultaneously.

The racks 46 are preferably designed to engage with the support columns associated with the inner slip-form, since in this way the same equipment can be used in the construction of above-ground and in-ground walls.

It should be appreciated that the invention can be embodied in many other ways than that described above. Especially it should be appreciated that the rollers composing the races may be mounted and attached in innumerable different ways as will be apparent to those skilled in the relevant art.

It should also be appreciated that the invention is not restricted to use with the positioning of pre-curved sections of horizontal reinforcing rods, and the rods may even be straight provided they are flexible enough to be curved to the contour of the wall.

I claim:

1. A slip-form having formwork for defining at least one surface of a wall-space into which reinforcing rods are located at selected positions to form a reinforcing structure for a poured concrete structure, the slip-form further including a plurality of spaced apart upwardly extending members supporting said formwork, and roller assemblies releasably engaged with at least some of the members, with a plurality of said roller assemblies being horizontally aligned and spaced to form within said space a height adjustable horizontal race and at least one of said roller assemblies being vertically and horizontally spaced from an adjacent roller assembly to form an inclined race feeding down to said horizontal race, said inclined race being adapted to transport reinforcing rods onto the horizontal race for onward transport to a location adjacent to a selected position in the reinforcing structure.

2. A slip-form as claimed in claim 1 in which the roller assemblies comprise rollers mounted in brackets which are releasably engageable with racks adjustably secured to the upwardly extending members.

3. A slip-form as claimed in claim 2 wherein a vertical pin is mounted at the distal end of each bracket in order to prevent the reinforcing rods from coming off the race.

4. A slip-form according to claim 1 or claim 2 in which the roller assemblies releasably engage with the upwardly extending members associated with the slip-form defining the inner surface of a curved wall.

5. A slip-form as claimed in claim 1 in which a skid channel is provided along the horizontal race in the region of the intersection with the inclined race.

6. A slip-form as claimed in claim 1 in which at least one motorised roller is provided at an upper end of the inclined race.

7. In a slip-form having means for defining at least one surface of a wall-space into which reinforcing rods are located at selected positions to form a reinforcing structure for a poured concrete structure, the improvement comprising a plurality of spaced apart upwardly extending members supporting said surface defining means, and a first set of roller assemblies releasably engaged with at least some of the members to form within said space a height adjustable horizontal race and a second set of roller assemblies releasably engaged with at least others of the members to form an inclined race feeding down to said horizontal race, said inclined race being adapted to transport reinforcing rods onto the horizontal race for onward transport to a location adjacent to a selected position in the reinforcing structure.

* * * * *